US007901183B1

(12) United States Patent
Liang

(10) Patent No.: US 7,901,183 B1
(45) Date of Patent: Mar. 8, 2011

(54) TURBINE BLADE WITH DUAL AFT FLOWING TRIPLE PASS SERPENTINES

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 715 days.

(21) Appl. No.: 12/017,487

(22) Filed: Jan. 22, 2008

(51) Int. Cl.
*F01D 5/18* (2006.01)

(52) U.S. Cl. ..... 416/97 R

(58) Field of Classification Search ..... 416/97 R
See application file for complete search history.

(56) References Cited

U.S. PATENT DOCUMENTS 5,395,212 A * 3/1995 Anzai et al. ..... 416/97 R

* cited by examiner

*Primary Examiner* — Richard Edgar
(74) *Attorney, Agent, or Firm* — John Ryznic

(57) ABSTRACT

A turbine blade with a low flow cooling circuit for the airfoil main body and the blade tip section which includes two 3-pass aft flowing serpentine flow cooling circuits. A first 3-pass serpentine circuit is located in the forward section with a first leg connected to a showerhead arrangement of film cooling holes. The third leg is connected to an upstream end of a blade tip cooling channel that extends toward the trailing edge and includes pin fins and a row of pressure side peripheral cooling holes to discharge cooling air. The second 3-pass circuit is located aft of the first 3-pass circuit and includes a third leg adjacent to the trailing edge region with a row of exit cooling holes connected to discharge cooling air from the serpentine. No film cooling holes are connected to the second and third legs of the two serpentine circuits so that low flow capability is achieved. A tip turn channel in the first serpentine provides blade tip cooling at a location upstream of the blade tip cooling channel.

16 Claims, 7 Drawing Sheets

TURBINE BLADE WITH DUAL AFT FLOWING TRIPLE PASS SERPENTINES

BACKGROUND OF THE INVENTION

1. Field of the Invention

The present invention relates generally to a turbine blade, and more specifically to low flow cooling demand for the airfoil and the tip regions.

2. Description of the Related Art Including Information Disclosed Under 37 CFR 1.97 and 1.98

In a gas turbine engine, a hot gas flow is developed in the combustor from the burning of a fuel with compressed air from the compressor and then passed through a multiple staged turbine to produce mechanical power. In an aero engine, the mechanical power drives the rotor shaft that is connected to a bypass fan. In an industrial gas turbine engine, the rotor shaft is connected, to an electric generator that will produce electrical power. In both engines, the engine efficiency can be increased by passing a higher temperature gas into the turbine. However, the turbine inlet temperature is limited to the material properties of the first stage turbine airfoils, these airfoils being the stator vanes and the rotor blades.

Complex internal airfoil cooling passages have been proposed to provide high levels of airfoil cooling using a minimal amount of cooling air. Higher turbine inlet temperatures are obtainable by providing improved airfoil cooling. Also, since the compressed air used to cool these airfoils is taken from the compressor, the use of a minimal amount of compressor bleed off air for the airfoil cooling will also increase the engine efficiency.

Airfoil cooling is also important in increasing the life of the airfoils. Hot spots can occur on sections of the airfoils that are not adequately cooled. These hot spots can cause oxidation that will lead to shortened life for the airfoil. Blade tips are especially subject to hot spots since it is nearly impossible to total eliminate the gap between the rotating blade tip and the stationary shroud that forms the gap. Without any gas, blade tip rubbing will occur which leads to other problems. Because of the presence of the tip gap, the hot gas can flow through the gap and expose the blade tip surface to the extreme high temperatures of the gas flow. Therefore, adequate blade tip cooling is also required to reduce hot gas flow leakage and to control metal temperature in order to increase part life.

Airfoils surfaces exposed to the high temperature gas flow are typically coated with a thermal barrier coating or TBC in order to allow for even higher temperatures. As the TBC technology improves, more industrial gas turbine (LOT) blades are applied with a thicker or low conductivity TBC. Cooling flow demand has been gradually reduced. FIG. 1 shows a prior art first stage turbine blade external pressure profile. As indicated by this figure, the forward region of the pressure side surface is exposed to high hot gas static pressure while the entire suction side of the airfoil is at much lower hot gas static pressure than the pressure side. As a result, there is not sufficient cooling flow for the design to split the total cooling flow into two or three flow circuits and utilize the forward flowing serpentine cooling design. Serpentine flow cooling circuits provide higher cooling capabilities than several straight channels in the airfoil because the overall cooling passage length is increased due to the looping of the circuit up and down the airfoil. Cooling flow for the blade leading and trailing edges has to be combined with the mid-chord flow circuit to form a single 5-pass serpentine flow circuit. However, for the forward 5-pass serpentine flow circuit with total blade cooling flow back flow margin (BFM) may become a design issue.

One prior art airfoil cooling design is the triple pass serpentine flow cooling design of FIG. 2 that includes a forward flowing 3-pass or triple pass circuit and an aft flowing triple pass serpentine circuit. The forward flowing serpentine flow circuit normally is designed in conjunction with the leading backside impingement plus a showerhead and pressure side and suction side film discharge cooling holes. The aft, flowing serpentine flow circuit is designed in conjunction with the airfoil trailing edge discharge cooling holes. This type of cooling flow circuit is called a dual triple pass cooling design. FIG. 3 shows a diagram view of the flow paths of the FIG. 2 circuit.

An alternative prior art cooling design utilizes the dual triple pass serpentine flow circuits for a high operating gas temperature is shown in FIG. 4 and is called the "Cold Bridge" cooling design. FIG. 5 shows a diagram view of this cooling circuit. In this particular cooling design, the leading edge airfoil is cooled with a self-contained flow circuit. The airfoil mid-chord section is cooled with a pair of triple pass serpentine flow circuits. However, both of the triple pass serpentine cooling flow circuits are flowing forward instead of one flowing forward and the other flowing aft-ward like in the "warm bridge" design of FIG. 2. For the first forward flowing triple pass serpentine cooling design used in the airfoil mid-chord region, the cooling air flows toward and discharges into the high hot gas side pressure section of the pressure side. In order to satisfy the back flow margin (BFM) criteria, a high cooling supply pressure is needed (to prevent ingestion of the hot gas flow into the airfoil interior through the film cooling holes) for this particular design, and thus inducing a high leakage flow. Since the last up-pass of the triple pass serpentine cavities provide film cooling air for both sides of the airfoil, in order to satisfy the back flow margin criteria for the pressure side film row the internal cavity pressure must be approximately 10% higher than the pressure side hot gas pressure which will result in over-pressuring the airfoil suction side film holes.

The second forward flowing serpentine flow circuit of FIG. 4 is designed in conjunction with the airfoil trailing edge discharge cooling holes. Cooling air for the airfoil trailing edge cooling is bled off from the triple pass serpentine first up pass cooling supply channel first to provide the airfoil trailing edge region cooling prior to any heating of the cooling air. In this particular cooling design, it achieves a direct trailing edge cooling with fresh cooling air and thus achieves the high temperature cooling design requirements.

The cooling circuit in FIG. 6 shows another prior art (1+3+3) serpentine flow cooling circuit for the first stage turbine blade. The flow path for the 1+3+3 flow circuit is shown in FIG. 7. For the second triple pass serpentine flow cooling circuit, the cooling air is used to provide cooling for the airfoil mid-chord region first, similar to the warm bridge design of FIG. 2. The cooling air then flows toward the airfoil trailing edge and discharges through the airfoil trailing edge cooling holes to provide cooling for the airfoil trailing edge corner.

For a low cooling flow designed and high temperature turbine blade that is coated with a TBC, a cooling design with cooling flow split three ways becomes unfeasible. Cooling air for the airfoil leading edge and trailing edge has to be combined into the serpentine flow circuit. However, cooling air flowing toward the airfoil leading edge with heated air will not be able to provide adequate leading edge region cooling.

The forward flowing triple pass circuit for the airfoil forward region has to be designed as an aft flowing serpentine flow cooling circuit.

BRIEF SUMMARY OF THE INVENTION

It is an object of the present invention to provide for a turbine blade with a serpentine flow cooling circuit that optimizes the use of blade tip section cooling air for the use of blade forward section main body serpentine flow cooling.

It is another object of the present invention to provide for a turbine blade with a serpentine flow cooling circuit that will optimize the use of the main stream pressure gradient for an industrial gas turbine blade that is applied with a thick or low conductivity TBC.

It is another object of the present invention to provide for a turbine blade with a serpentine flow cooling circuit that provides cooling for the airfoil main body and the tip section with relatively low cooling flow.

The present invention is a dual triple pass aft flowing serpentine flow cooling circuit for a turbine airfoil, in particular for a first stage turbine blade used in an industrial gas turbine engine. A first aft flowing triple pass serpentine flow cooling circuit is located along the leading edge and provides cooling for the forward section of the airfoil main body as well as film cooling for the leading edge surface through showerhead film cooling holes. The spent cooling air discharged from the first aft flowing serpentine flows into a tip region cooling circuit that provides cooling for the aft region of the tip with film cooling holes spaced along the pressure side edge for cooling here. The spent cooling air from the tip region cooling channel is discharged through an exit cooling hole in the tip section. A second aft flowing triple pass serpentine flow cooling circuit is located aft of the first triple pass serpentine circuit and provides cooling for the aft section of the airfoil main body. The last leg is adjacent to the trailing edge of the airfoil and is connected to a row of exit cooling holes along the trailing edge to discharge the spent cooling air from the serpentine circuit out through the trailing edge.

The cooling circuit provides for adequate cooling of the main body airfoil, film cooling holes and tip region with the use of a low cooling flow. This cooling circuit will maximize the use of cooling to mainstream gas side pressure potential as well as tailor the airfoil external heat load. Fresh cooling air is supplied through the airfoil leading edge cavity first in order to enhance the internal heat transfer performance and conducting heat from the airfoil walls. The spent cooling air is then discharged into the blade tip cooling flow channel at the aft section of the airfoil where the gas side pressure is low and thus yields a high cooling air to main stream pressure potential to be used for the serpentine channels and maximize the internal cooling performance for the serpentine. In addition, this approach yields a lower cooling supply pressure requirement and lower leakage flow.

DETAILED DESCRIPTION OF THE INVENTION

The present invention is a dual triple pass aft flowing serpentine flow cooling circuit for a turbine airfoil, in particular for a first stage turbine blade used in an industrial gas turbine engine. FIGS. 8 through 12 shows various cross sections of the blade cooling circuit. The cooling circuit provides for adequate cooling of the main body airfoil, film cooling holes and tip region with the use of a low cooling flow. The serpentine flow cooling circuit includes two separate triple pass serpentine flow circuits for the entire blade cooling design. Both triple pass serpentine flow circuits are aft flowing to provide the cooling for the leading edge and the trailing edge of the airfoil.

Figure 1:
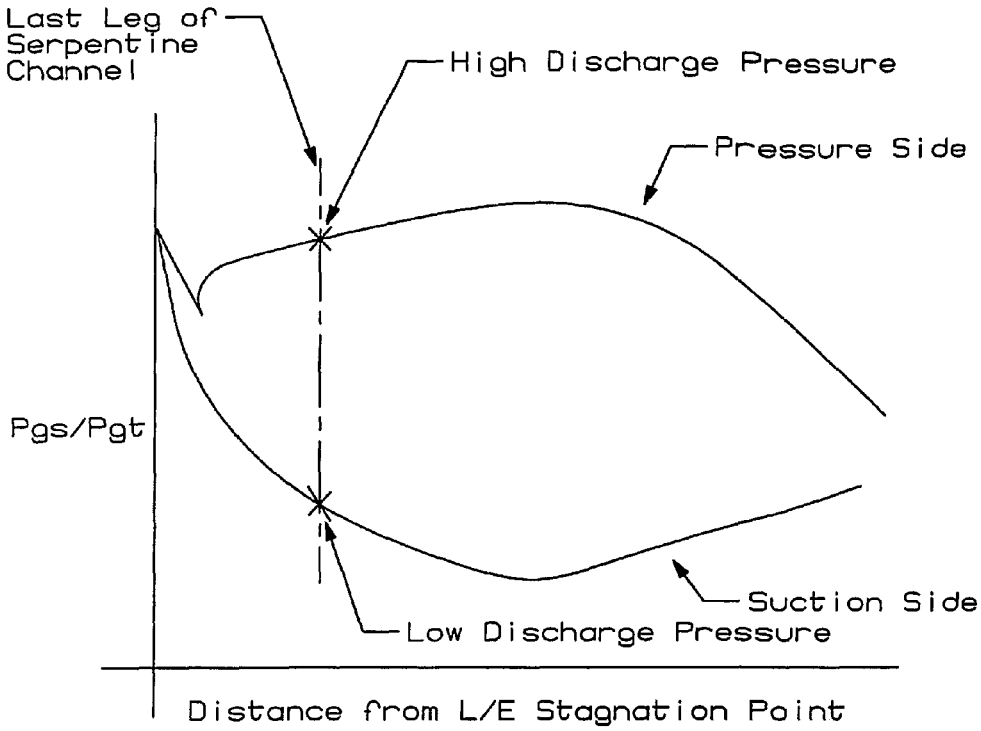
FIG. 1 shows a prior art first stage turbine blade external pressure profile.
Figure 2:
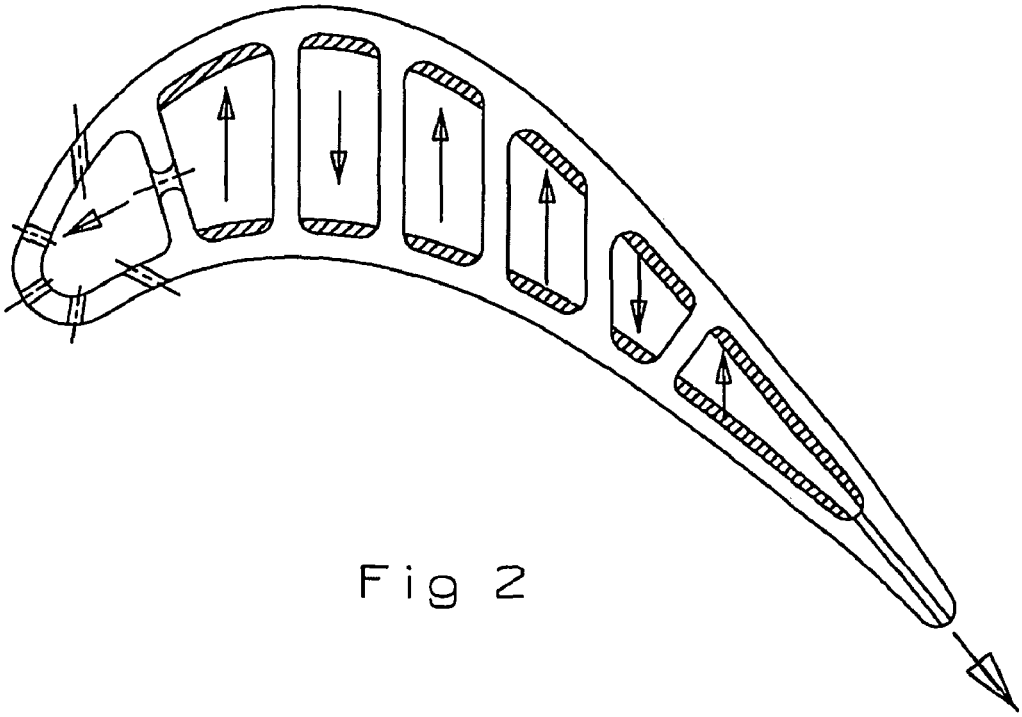
FIG. 2 shows a cross section top view of a dual triple pass serpentine cooling circuit of the prior art referred to as a "warm bridge" cooling design.
Figure 3:
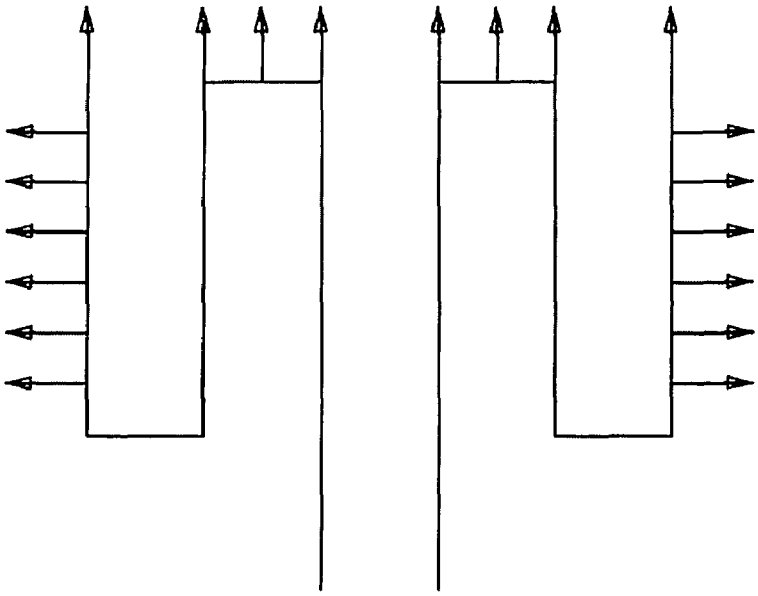
FIG. 3 shows a diagram view of the warm bridge serpentine flow circuit of FIG. 2.
Figure 4:
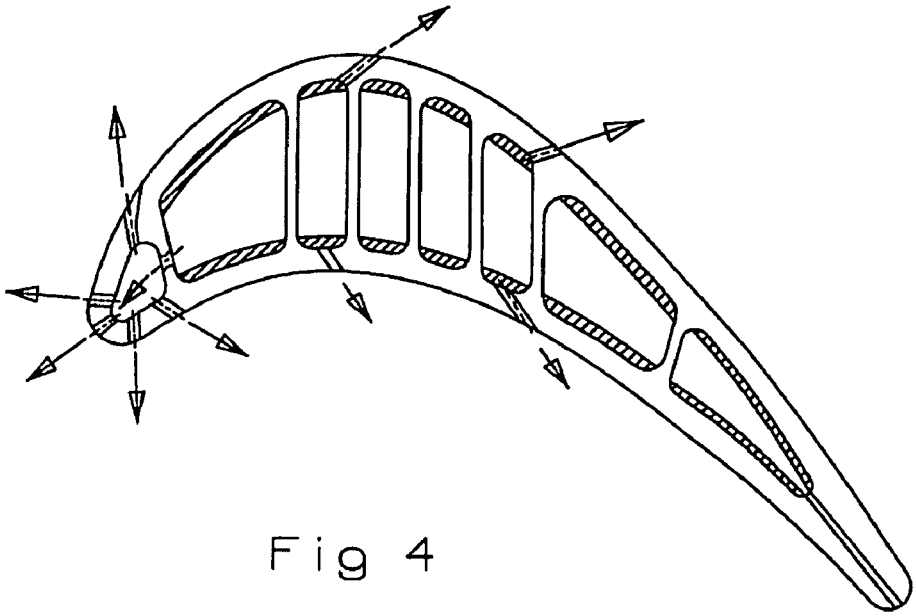
FIG. 4 shows a cross section top view of a 1+3+3 serpentine cooling circuit of the prior art referred to as a "cold bridge" cooling design.
Figure 5:
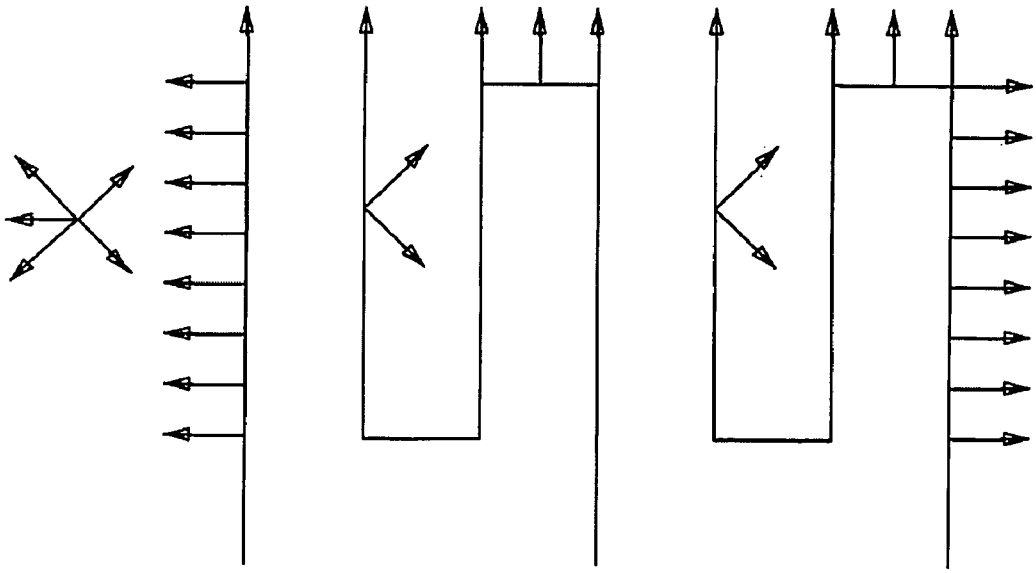
FIG. 5 shows a diagram view of the cold bridge serpentine flow circuit of FIG. 4.
Figure 6:
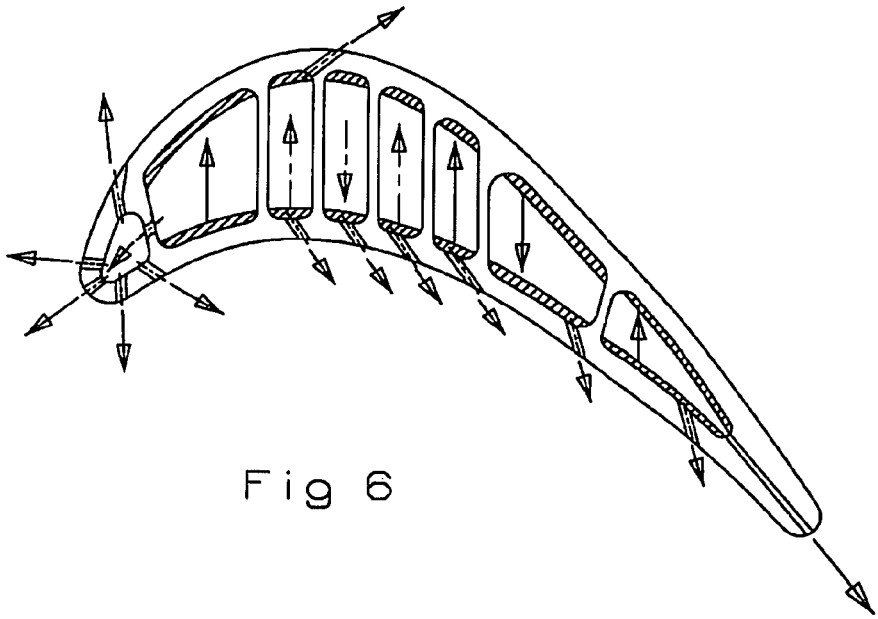
FIG. 6 shows, a cross section side view of another 1+3+3 serpentine cooling circuit of the prior art.
Figure 7:
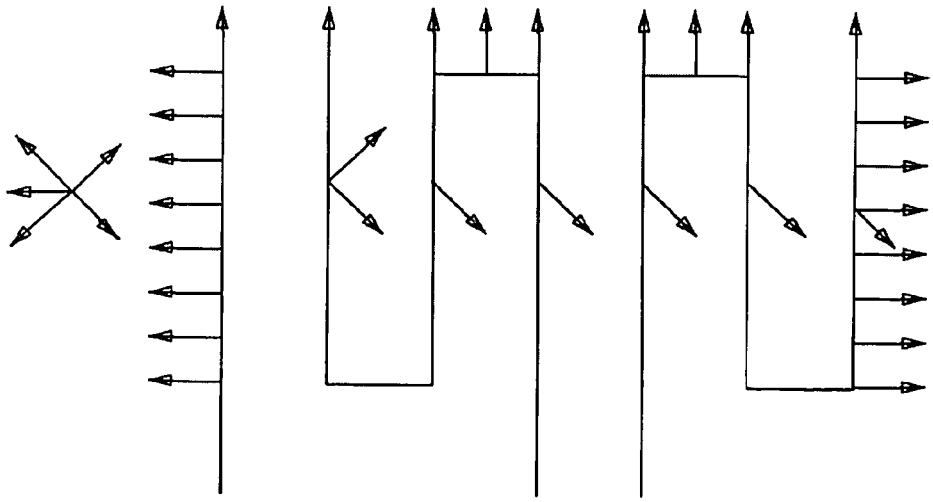
FIG. 7 shows a diagram view of the serpentine flow cooling circuit of the cooling circuit in FIG. 6.
Figure 8:
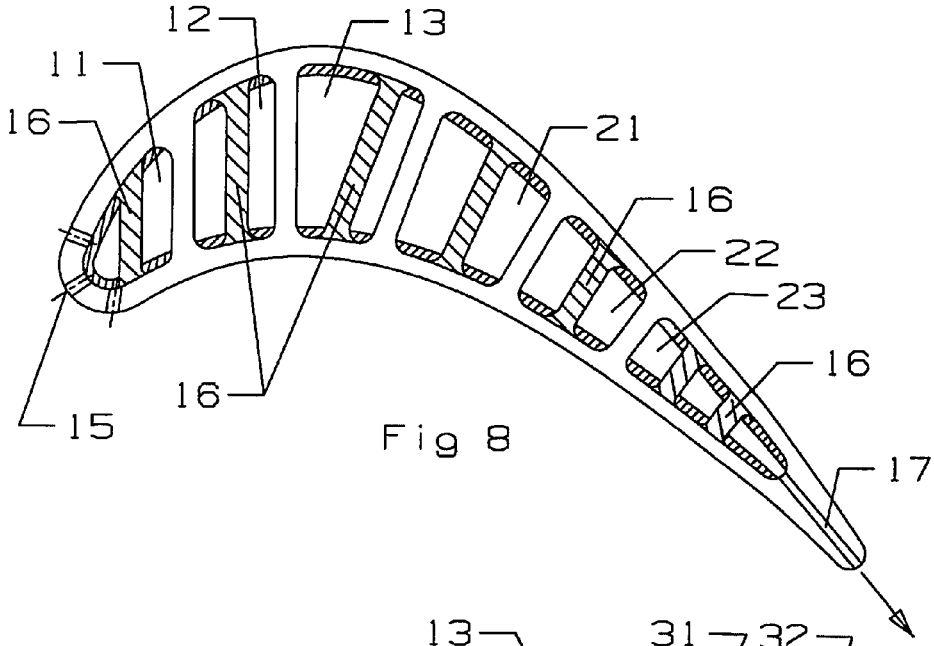
FIG. 8 shows a cross section top view of the blade main body cooling circuit of the present invention taken through line A-A shown in FIG. 9.
Figure 9:
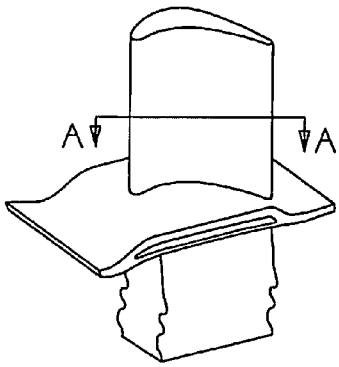
FIG. 9 shows a prior art first stage turbine blade in which the cooling circuit of the present invention is used.

FIG. 8 shows the cooling circuit through a cross section of line A-A shown in FIG. 9. The forward triple pass serpentine flow cooling circuit includes a first leg or up pass channel 11 followed in series by a second leg (down pass) 12 and a third leg 13 (up pass) channel. Pin fins 16 extend across each channel from the pressure side wall to the suction side wall. A showerhead arrangement of film cooling holes 15 is spaced along the leading edge of the airfoil and connected to the first leg 11 channel.

At the end of the third leg 13 in the forward or first serpentine flow circuit is a tip cooling air feed hole 19 that opens into a tip section chordwise cooling channel 31 that extends along the tip from the feed hole 19 to the trailing edge region of the blade tip. The tip turn 18 between the first and second legs 11 and 12 of the first or forward serpentine circuit is separated from the cooling air feed hole 19 by a rib extending from the pressure side wall to the suction side wall so that the serpentine circuit and the feed hole 19 do not mix cooling air. A trailing edge cooling exit hole 33 discharges cooling air from the tip section channel 31 and out the trailing edge of the tip. Pin fins 16 are also located within the tip section channel 31 arranged in the blade spanwise or radial direction to enhance the heat transfer coefficient. Located along the pressure side periphery of the tip is a row of pressure side peripheral cooling holes 32.

Figure 10:
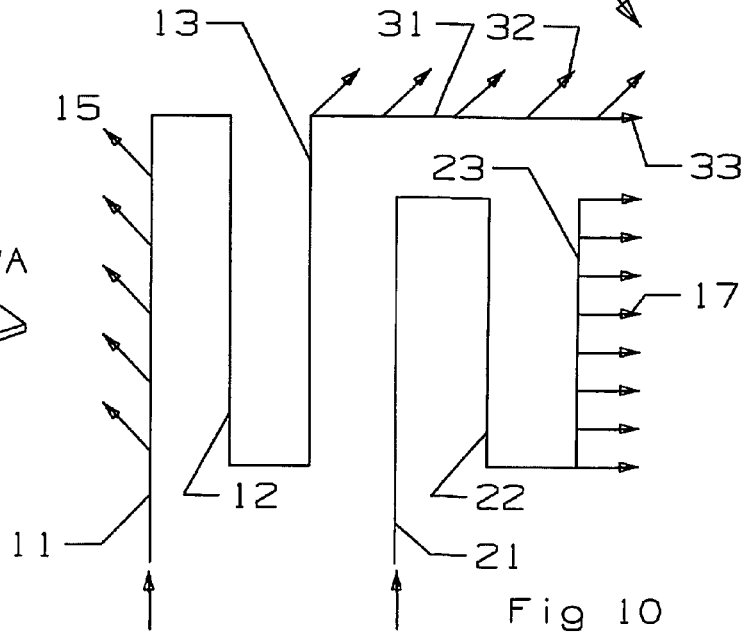
FIG. 10 shows a diagram view of the serpentine flow cooling circuit of the present invention of FIG. 8.
Figure 11:
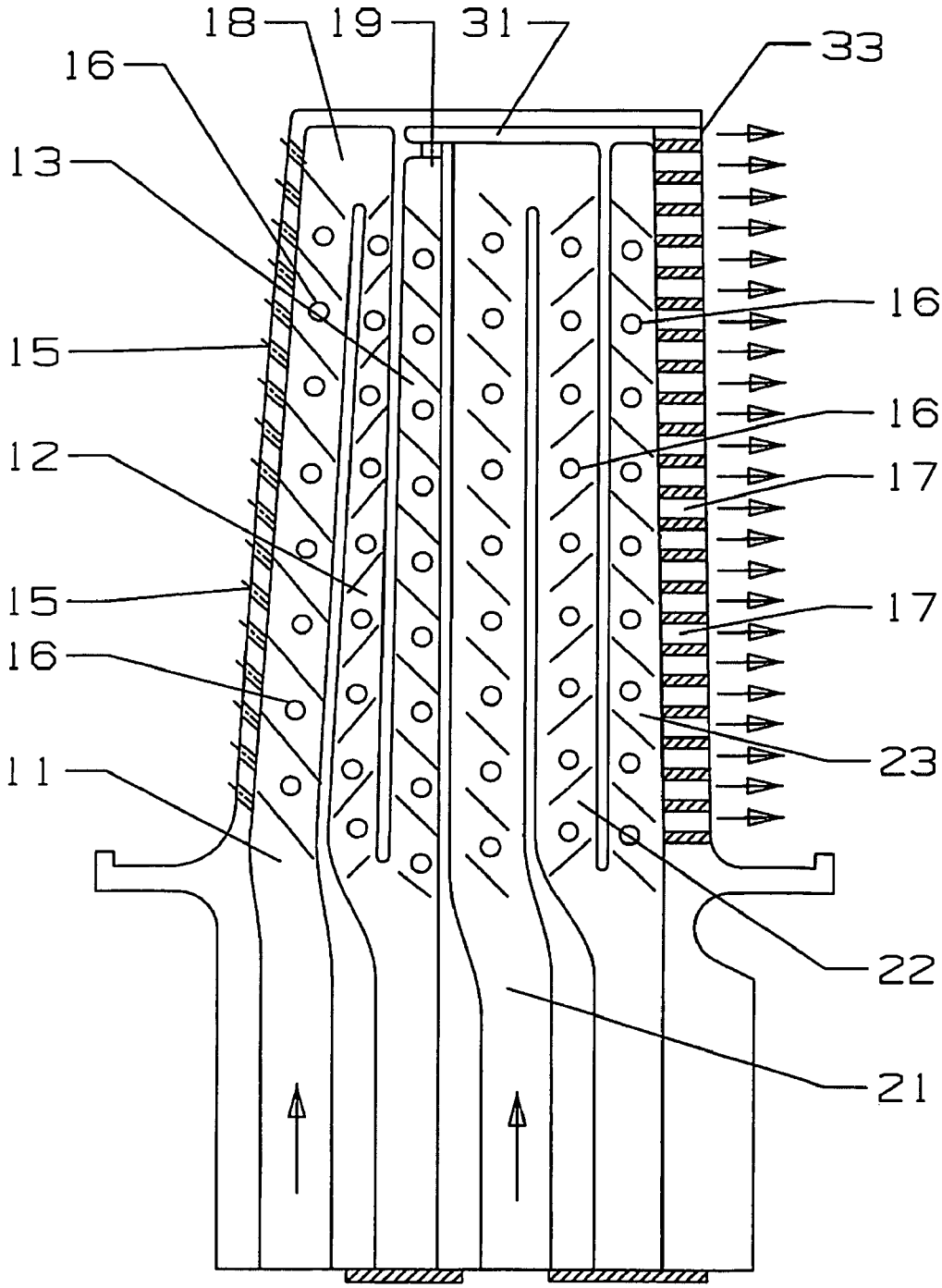
FIG. 11 shows a cross section side view of the blade cooling circuit of the present invention.
Figure 12:
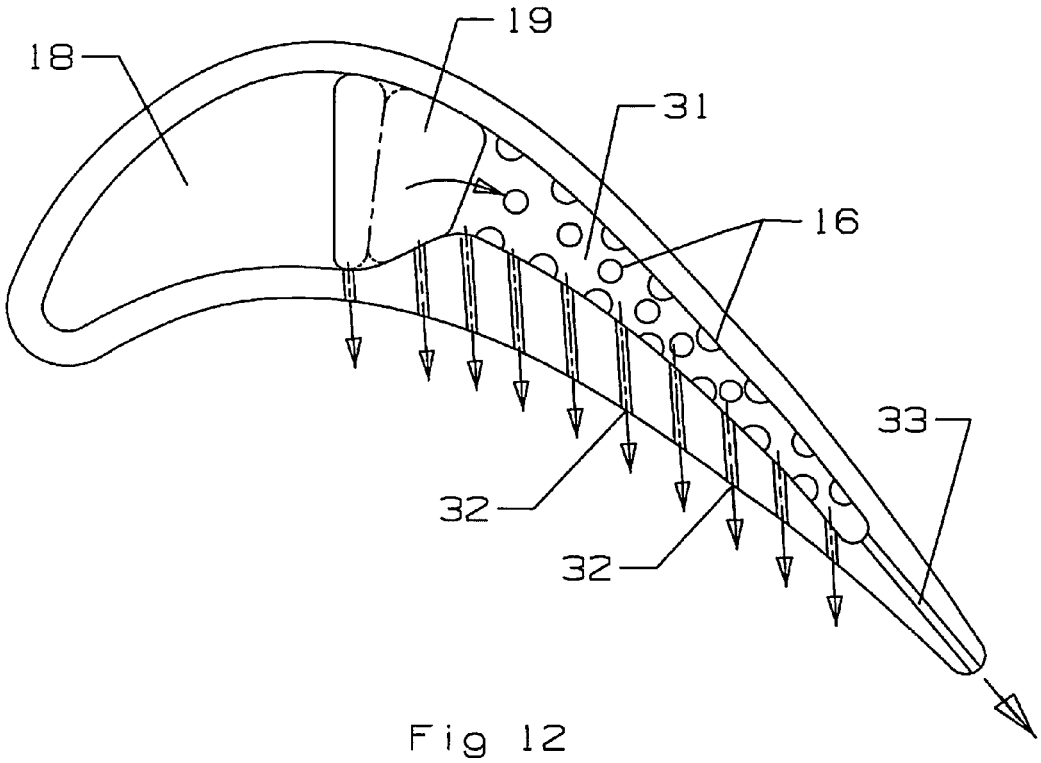
FIG. 12 shows a cross section top view of the tip region cooling circuit of the present invention.

A second triple pass serpentine flow cooling circuit is located aft of the first serpentine and includes a first leg or up pass channel 21 followed in series by a second leg (down pass) 22 and a third leg 23 (up pass) channel. Pin fins 16 also extend across each channel from the pressure side wall to the suction side wall. The last leg or channel 23 is connected to a row of trailing edge exit holes or slots 17 that discharge cooling air from the aft or second serpentine circuit. FIG. 10 shows a diagram representation of the cooling, circuit flows with film holes and exit holes.

Operation of the cooling circuit within the blade is as follows. Pressurized cooling air is supplied from an external source, such as a compressor, to the two first legs or channels 11 and 21 of the two triple pass serpentine flow cooling circuits. Cooling air for the blade leading edge cooling and tip section cooling is provided by the first triple pass serpentine flow circuit while the blade trailing edge cooling flow is channeled through the second triple pass serpentine flow circuit. The aft flowing serpentine flow cooling circuit used for the airfoil leading edge and mid-chord section will maximize the use of cooling to mainstream gas side pressure potential as well as tailor the airfoil external heat load. Fresh cooling air is supplied through the airfoil leading edge cavity first in order to enhance the internal heat transfer performance and conducting heat from the airfoil walls.

Cooling air then flows in a serpent path rearward through the forward section of the airfoil surface. A parallel flow cooling flow process is used for the airfoil forward surface where the cooling air flows inline with the airfoil external pressure and heat load. This maximizes the use of cooling air pressure to mainstream gas side pressure potential as well as tailor the airfoil external heat load. A cooling design of the present invention is particularly applicable to the airfoil pressure side just aft of the leading edge where the airfoil heat load is low and thus eliminates the use of film cooling. Pin fins in conjunction with trip strips within the serpentine flow channels with enhance the heat transfer coefficient.

The spent cooling air is then discharged into the blade tip cooling flow channel at the aft section of the airfoil where the gas side pressure is low and thus yields a high cooling air to main stream pressure potential to be used for the serpentine channels and maximize the internal cooling performance for the serpentine. In addition, this approach yields a lower cooling supply pressure requirement and lower leakage flow. Trip strips are built in on the inner wall of the tip section cooling channel for the cooling of the airfoil suction side wall and the squealer tip floor. Multiple-film cooling holes are drilled from the blade pressure side tip periphery to provide airfoil pressure side edge cooling as well as film cooling for the blade squealer tip.

For the second aft flowing triple pass serpentine flow cooling circuit, cooling air is channeled into the airfoil mid-chord section this maximizes the use of airfoil trailing edge cooling air for the cooling of the airfoil main body first and thus achieves a low mass average metal temperature for the airfoil. This translates into a higher creep capability for the blade. The cooling air is channeled through the trailing edge pin fin bank radial channel to provide cooling for the airfoil trailing edge section, and then exits out of the airfoil trailing edge through multiple small holes for the cooling of the airfoil trailing edge corner.

In summary, the new dual aft flowing triple pass serpentine blade cooling circuit of the present invention maximizes the usage of cooling air for a given airfoil inlet gas temperature and pressure profile also, the use of a pin fin bank in the serpentine cooling channels minimize the rotational effect on internal channel heat transfer performance, and increases serpentine channel through flow velocity, creates extremely high turbulence level in the coolant flow, and thus enhances the internal heat transfer coefficient values. In addition to the high internal convective area and conduction path, it creates by the intricacy of the cooling passages; the use of pin fin bank in the serpentine flow channel will minimize rotational affects impact on the cooling channel internal heat transfer coefficient. As a result, this yields a very high internal convective cooling effectiveness than the open serpentine flow channel used in the prior art described above and provides additional heat balance for the airfoil pressure and suction side walls. A balanced life blade cooling concept is achieved.

Major design features and advantages of the cooling circuit of the present invention over the prior art triple pass forward flowing serpentine circuit is described below. The circuit of the present invention will: 1) minimize the blade BFM issue; 2) the blade cooling air is fed through the airfoil forward section and flows toward the airfoil trailing edge and thus maximizes the use of cooling pressure potential; 3) higher cooling mass flow through the airfoil main body yields a lower mass average blade metal temperature which results in a higher stress rupture life for the blade; 4) tip section cooling is used for the blade cooling first prior to usage in the tip section cooling. This double the use of cooling air will maximize the blade cooling effect and minimize the low Mach number region at the end of the serpentine cooling channel; 5) all the high heat transfer is generated by the pin fins and trip strips within the dual triple pass serpentine flow channels; 6) the aft flowing 3-pass cooling flow path maximizes the use of cooling air and provides a very high overall cooling efficiency for the entire airfoil, especially with the tip section cooling being channeled through the entire 3-pass serpentine flow circuit; 7) the aft flowing serpentine flow cooling circuit used for the airfoil main body will maximize the use of cooling to main stream gas side pressure potential. Portion of the air is discharged at the aft section of the airfoil where the gas side pressure is low and thus yields a high cooling air to main stream pressure potential to be used for the serpentine channels and maximize the internal cooling performance for the serpentine; 8) the aft flowing main body 3-pass serpentine flow channel yields a lower cooling supply pressure requirement and a lower leakage.

I claim the following:

1. A turbine blade comprising:

a first triple pass serpentine flow cooling circuit located in a forward section of the airfoil;

a second triple pass serpentine flow cooling circuit located aft of the first triple pass serpentine flow cooling circuit;

a blade tip section cooling channel extending along the chordwise direction of the blade tip to provide cooling for the blade tip;

the blade tip section cooling channel being fluidly connected to the first triple pass serpentine flow cooling circuit;

a row of cooling holes on the pressure side peripheral of the blade tip and in fluid communication with the blade tip section cooling channel; and, a row of exit cooling holes spaced along the trailing edge of the airfoil and in fluid communication with the second triple pass serpentine flow cooling circuit.

2. The turbine blade of claim 1 and further comprising:

the last leg of the first triple pass serpentine flow cooling circuit is connected to an upstream location of the blade tip section cooling channel through a tip cooling air feed hole.

3. The turbine blade of claim 1 and further comprising:

the blade tip section cooling channel is located substantially on the suction side wall of the blade tip and the pressure side peripheral cooling holes are located substantially on the pressure side.

4. The turbine blade of claim 3 and further comprising:

pin fins and trip strips located along the blade tip section cooling channel.

5. The turbine blade of claim 1 and further comprising:

the first leg of the second triple pass serpentine flow cooling circuit is located aft of and adjacent to the last leg of the first triple pass serpentine flow cooling circuit.

6. The turbine blade of claim 1 and further comprising:

a first tip turn channel connecting the first leg to the second leg of the first triple pass serpentine flow cooling circuit, the first tip turn channel being located underneath the blade tip such that impingement cooling of the blade tip section occurs as the cooling air passes around the first tip turn channel.

7. The turbine blade of claim 6 and further comprising:

a tip cooling supply channel connecting the first triple pass serpentine, flow cooling circuit to the blade tip section cooling channel, the tip cooling supply channel being located aft and adjacent to the first tip turn channel.

8. The turbine blade of claim 1 and further comprising:

pin fins and trip strips located along the first and second triple pass serpentine flow cooling circuits.

9. The turbine blade of claim 1 and further comprising:

a row of trailing edge cooling holes connected to the last leg of the second triple pass serpentine flow cooling circuit.

10. The turbine blade of claim 1 and further comprising:

a trailing edge cooling hole in the tip section connected to the blade tip section cooling channel.

11. The turbine blade of claim 1 and further comprising:

a second tip turn channel connecting the first leg to the second leg of the second triple pass serpentine flow cooling circuit, the second tip turn channel being located underneath the blade tip cooling channel such that impingement cooling of the blade tip cooling channel section occurs as the cooling air passes around the second tip turn channel.

12. The turbine blade of claim 1 and further comprising:

the legs of the first and second triple pass serpentine flow cooling circuits each extend from the pressure side wall to the suction side wall.

13. The turbine blade of claim 1 and further comprising:

the first and second triple pass serpentine flow cooling circuits are both aft flowing circuits.

14. The turbine blade of claim 1 and further comprising:

the first and second triple pass serpentine flow cooling circuits are separate cooling circuits within the airfoil.

15. The turbine blade of claim 1 and further comprising:

the second and third legs of the first and second triple pass serpentine flow cooling circuits do not connect to any film cooling holes on the airfoil walls.

16. The turbine blade of claim 1 and further comprising:

showerhead film cooling holes being connected directly to the first leg of the first triple pass serpentine flow cooling circuit.

* * * * *